US006478696B1

(12) United States Patent
Yamagishi et al.

(10) Patent No.: US 6,478,696 B1
(45) Date of Patent: Nov. 12, 2002

(54) SOLID GOLF BALL

(75) Inventors: Hisashi Yamagishi; Takashi Maruko; Yutaka Masutani; Atsushi Nakamura, all of Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/466,066

(22) Filed: Dec. 17, 1999

(30) Foreign Application Priority Data

Jul. 9, 1999 (JP) ..... 11-195818

(51) Int. Cl.[7] ..... A63B 37/06
(52) U.S. Cl. ..... 473/376
(58) Field of Search ..... 473/367, 368, 473/370, 371, 373, 374, 376

(56) References Cited

U.S. PATENT DOCUMENTS

| | | | | |
|---|---|---|---|---|
| 5,772,531 A | * | 6/1998 | Ohsumi et al. | 473/376 |
| 6,071,201 A | * | 6/2000 | Maruko | 473/373 |
| 6,010,412 A1 | * | 2/2001 | Moriyama | 473/373 |
| 6,187,864 B1 | * | 2/2001 | Rajagopalan | 473/378 |

* cited by examiner

*Primary Examiner*—Mark S. Graham
*Assistant Examiner*—Raeann Gorden

(57) ABSTRACT

In a solid golf ball of multilayer structure comprising a core, an enclosing layer, and a cover, the core and the enclosing layer have volumes $V_1$ and $V_2$ which satisfy $0.05\% \leqq V_1/V_2 \times 100\% \leqq 60\%$, and the core has a rebound of A (cm) and the core enclosed with the enclosing layer has a rebound of B (cm) both when dropped from a height of 120 cm, which satisfy A<B. The ball travels an increased carry at both high and low club-head speeds and ensures greater carry for low head speed players.

23 Claims, 1 Drawing Sheet

SOLID GOLF BALL

BACKGROUND OF THE INVENTION

1. Field of the Invention

The present invention relates to a golf ball which even when hit at a relatively low golf-club head speed, acquires a high initial velocity and thus provides improved carry.

2. Related Art

One of the aspects of performance most desired in golf ball development is improved carry.

The Rules of Golf which regulate golf competition include provisions relating to the flight distance of the ball. The initial velocity and overall distance standard are set forth in paragraphs d. and e. of Appendix III. Technical innovations in golf balls are generally developed in keeping with these rules.

A variety of multi-piece golf balls such as three-piece and four-piece balls have been devised. Because most such balls are developed in conformity with the Rules of Golf, they are designed primarily for high head speed players and often fail to provide an acceptable carry when hit by a low head speed player.

SUMMARY OF THE INVENTION

An object of the present invention is to provide a solid golf ball having an increased initial velocity regardless of whether the club head speed is low or high, and having in particular an excellent rebound and distance when hit at a low head speed.

Under the circumstances that professional golfers and skilled amateurs are high head speed players, but the majority of golfers have a relatively low head speed, the inventor has succeeded in developing a golf ball that has excellent rebound characteristics so that the ball is highly advantageous to the majority of golfers who have a relatively low head speed.

In a first aspect, the invention provides a solid golf ball of multilayer structure comprising a core, an enclosing layer around the core, and a cover. The core and the enclosing layer have volumes which satisfy the following relationship: $0.05\% \leqq (\text{core volume})/(\text{enclosing layer volume}) \times 100\% \leqq 60\%$. The core has a rebound of A (cm) and the core enclosed with the enclosing layer, referred to as enclosed core, has a rebound of B (cm) both when dropped under gravity from a height of 120 cm, and the rebound of the bare core is smaller than the rebound of the enclosed core, that is, $A<B$. Preferably, the core has a diameter of 1 to 16 mm, and the rebound B of the enclosed core is at least 90 cm.

As to the preferred materials of which the respective layers are made, the core is comprised of a thermoplastic resin as a base; and the enclosing layer is comprised of a thermoplastic resin as a base. Typically, the core is formed of a composition comprising 100 parts by weight of a base and up to 40 parts by weight of an inorganic filler. More preferably, each of the core, the enclosing layer, and the cover is formed of a composition comprising 100 parts by weight of a base and up to 40 parts by weight of an inorganic filler.

In a second aspect, the invention provides a solid golf ball of multilayer structure comprising a core, an enclosing layer around the core, and a cover, wherein each of the core, the enclosing layer, and the cover is comprised of a thermoplastic resin as a base. The golf ball may further have an intermediate layer between the enclosing layer and the cover, the intermediate layer being comprised of a thermoplastic resin as a base. More preferably, the core is formed of a composition comprising 100 parts by weight of the base and up to 40 parts by weight of an inorganic filler. Most preferably, each of the core, the enclosing layer, and the cover is formed of a composition comprising 100 parts by weight of the base and up to 40 parts by weight of an inorganic filler.

In one preferred embodiment of the second aspect, the core and the enclosing layer have volumes which satisfy the following relationship: $0.05\% \leqq (\text{core volume})/(\text{enclosing layer volume}) \times 100\% \leqq 60\%$. The core preferably has a diameter of 1 to 16 mm. The core enclosed with the enclosing layer preferably has a rebound of at least 90 cm when dropped under gravity from a height of 120 cm.

The golf ball of the invention has such rebound efficiency that the ball conforms to the rule for initial velocity by delivering a lower initial velocity than the stipulated value at the relatively high head speed range for which the rules are established, yet enables a relatively high initial velocity to be achieved at lower head speeds. That is, the invention provides a golf ball which, based on the deformation that occurs in the relatively high compression range (high head speed players) to which the above rules most directly apply, holds down rebound only in this range while increasing rebound in the low head speed range where most golfers belong, thus providing the average player with better rebound characteristics. The invention achieves a golf ball that is highly advantageous to the majority of golfers who have a relatively low head speed of less than about 42 m/s, and especially less than about 40 m/s.

BRIEF DESCRIPTION OF THE DRAWINGS

The objects, features and advantages of the invention will become more apparent from the following detailed description.

DETAILED DESCRIPTION OF THE INVENTION

Figure 1:
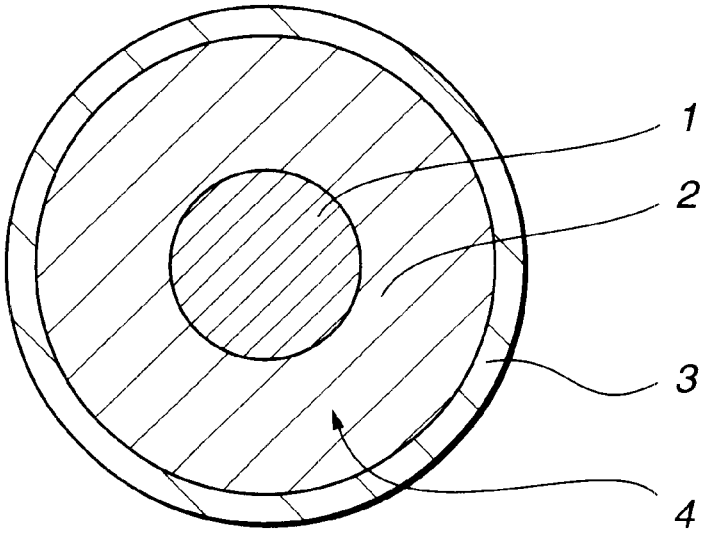
FIG. 1 is a sectional view showing a solid golf ball according to one embodiment of the invention.
Figure 2:
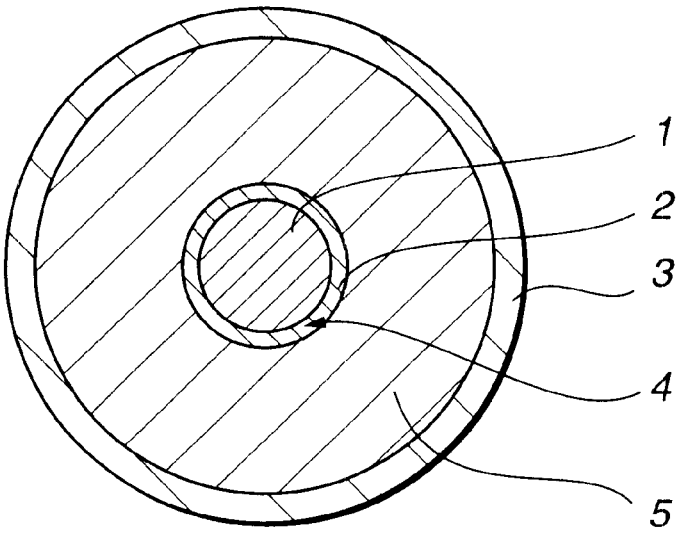
FIG. 2 is a sectional view showing a solid golf ball according to another embodiment of the invention.

Referring to FIG. 1, the solid golf ball according to one embodiment of the invention is illustrated as having a three-layer structure comprising a core 1, an enclosing layer 2 that encloses the core 1, and a cover 3 that encloses the enclosing layer 2. The core 1 enclosed with the enclosing layer 2 is sometimes referred to as an enclosed core 4. The golf ball of the invention may be formed to a structure of more than three layers. The golf ball according to another embodiment of the invention is illustrated in FIG. 2 as having a four-layer structure comprising a core 1, an enclosing layer 2 that encloses the core 1 to define an enclosed core 4, an intermediate layer 5 that encloses the enclosed core, and a cover 3 that encloses the intermediate layer 5. Differently stated, the intermediate layer 5 is disposed between the enclosing layer 2 and the cover 3. The golf ball of the invention is not limited to the three and four-layer structures illustrated herein and may be constructed of more layers. For example, the cover may be formed to a multilayer structure of two or more layers.

The core of the inventive solid golf ball preferably has a rebound height of less than 95 cm when dropped under gravity from a height of 120 cm onto an iron plate of sufficient thickness. More preferably, this rebound height is less than 90 cm, especially less than 88 cm and at least 50 cm, especially at least 60 cm. The core may be made of any suitable material so long as it has the rebound characteristics defined above. The core may be formed of a rubber material although the use of a thermoplastic resin as a base is recommended herein.

Illustrative examples of such thermoplastic resins include thermoplastic polyurethane elastomers, thermoplastic polyester elastomers, thermoplastic polyamide elastomers, polyarylates, ionomer resins, and polypropylene resins. Some examples of highly suitable commercial products include Pandex (thermoplastic polyurethane elastomers manufactured by Dainippon Ink & Chemicals Co., Ltd.), Hytrel (thermoplastic polyester elastomers manufactured by Toray-Dupont Co., Ltd.), Surlyn (ionomer resins manufactured by E. I. DuPont de Nemours and Co.), Himilan (ionomer resins manufactured by DuPont-Mitsui Polychemicals Co., Ltd.), Rilsan (thermoplastic polyamide elastomers manufactured by Toray-Dupont Co., Ltd.) and U-Polymer (polyarylate resins manufactured by Unitika, Ltd.).

An inorganic filler such as zinc oxide, barium sulfate or tungsten may be compounded in the base material making up the core. The addition of inorganic filler in an amount of not more than 40 parts by weight, and especially not more than 38 parts by weight, per 100 parts by weight of the base is preferable for enhancing the workability of the overall composition during kneading. Too much inorganic filler may lower the workability of the composition during kneading.

The core may be injection molded if the base is a thermoplastic elastomer as mentioned above.

The core has a diameter of at least 1 mm, preferably at least 2 mm, more preferably at least 3 mm and up to 16 mm, preferably up to 15.5 mm, more preferably up to 15 mm. A core having too large a diameter would impart poor resilience or restitution to the golf ball because the core itself has relatively low resilience or rebound.

The enclosing layer that surrounds the core may be made of a rubber material although it is preferably made of a thermoplastic resin as described above for the core. Like the core, an inorganic filler may be compounded in the base material making up the enclosing layer. The addition of not more than 40 parts by weight, and especially not more than 38 parts by weight of the inorganic filler per 100 parts by weight of the base is preferable for the same reason as above.

If the enclosing layer is made of a resin material, it may be formed by a known injection molding process involving placing the preformed core within an injection mold and injecting the molten material into the mold cavity.

According to the first aspect of the invention, the core 1 and the enclosing layer 2 have volumes $V_1$ and $V_2$, respectively, which satisfy $0.05\% \leqq V_1/V_2 \times 100\% \leqq 60\%$. The percent $V_1/V_2$ is at least 0.05%, preferably at least 0.1%, more preferably at least 0.15%, further preferably at least 0.2% and up to 60%, preferably up to 59%, more preferably up to 58.5%, further preferably up to 58%. A lower percent $V_1/V_2$ would fail to achieve the objects of the invention whereas a higher percent $V_1/V_2$ would cause the ball to lose resilience.

Also according to the first aspect of the invention, the core has a rebound of A (cm) and the enclosed core (that is, the core enclosed with the enclosing layer) has a rebound of B (cm), which satisfy A<B. The rebound is measured as previously defined. If the rebound of the enclosed core is smaller than the rebound of the bare core, the ball has insufficient rebound or resilience and travels short.

Preferably the enclosed core (that is, the core enclosed with the enclosing layer) has a rebound of at least 90 cm, more preferably at least 90.5 cm, and most preferably at least 90.8 cm. The upper limit of rebound is not critical although it is usually 110 cm or lower.

Also preferably the enclosed core has a diameter of at least 5 mm, more preferably at least 8 mm, most preferably at least 10 mm and up to 41.5 mm, more preferably up to 41 mm, most preferably up to 40.5 mm.

In the practice of the invention, an intermediate layer may be formed so as to surround the enclosing layer if necessary. The intermediate layer is preferably formed of a thermoplastic resin as a base, examples of which are as described above. The blending of an inorganic filler in the intermediate layer is the same as described for the core and the enclosing layer. The intermediate layer may be formed by injection molding or similar process.

The intermediate layer, when formed, preferably has a thickness or gage of at least 0.3 mm, especially at least 0.5 mm and up to 8 mm, especially up to 6 mm. A sphere consisting of the core, enclosing layer and intermediate layer should preferably have a greater rebound than the bare core, illustratively of at least 90 cm, especially at least 92 cm.

The cover that surrounds the enclosed core or the sphere (that is, the enclosed core plus the intermediate layer) may be formed of thermoplastic resins, for example, ionomer resins and polyurethane-, polyamide- or polyester-based thermoplastic elastomers as a base. An inorganic filler may be compounded in the base material. It is recommended to add the inorganic filler in an amount of not more than 40 parts by weight, and especially not more than 38 parts by weight, per 100 parts by weight of the base. Too much inorganic filler would lower the workability of the composition. The cover may be formed by any desired molding method which is selected depending on the particular type of cover stock used. Most often, injection molding is advantageously employed.

Preferably, the cover has a thickness or gage of at least 0.5 mm, and especially at least 1 mm, but not more than 4 mm. The cover preferably has a Shore D hardness of at least 30, more preferably at least 35, and most preferably at least 40. The upper limit in the Shore D hardness of the cover is preferably 75, more preferably 70, and most preferably 65. Too low a hardness in the cover would give the golf ball insufficient rebound, and excessive hardness may result in poor durability. As noted above, the cover may have a multilayer construction, in which case the overall properties of the combined layers should fall within the above ranges.

According to the second aspect of the invention, each of the ball layers, that is, the core, enclosing layer, intermediate layer if any, and cover is formed of a thermoplastic resin as a base. By forming all the layers from thermoplastic resins, the ball is given the desired initial velocity and increased distance regardless of whether the head speed is high or low.

Like conventional golf balls, the golf ball of the invention generally has about 300 to 600 dimples which are distributed on the surface of the cover in a conventional well-known arrangement.

The golf ball of the invention may be formed so as to have a diameter and weight which are in accordance with the Rules of Golf. That is, the ball has a diameter of not less than 42.65 mm and especially not less than 42.67 mm, yet preferably not more than 42.75 mm; and a weight of preferably not more than 45.90 grams, yet not less than 45.10 grams.

There has been described a solid golf ball which travels an increased carry when hit at either a low or high head speed, and in particular, offers greater carry to low head speed players.

EXAMPLES

Examples of the invention and comparative examples are given below by way of illustration, and are not intended to limit the invention.

Examples and Comparative Examples

Using the resin components or rubber components formulated as shown in Table 1, golf ball cores, enclosing layers, intermediate layers, and covers were conventionally formed in this order to the specifications shown in Table 1, giving golf balls having dimples of identical shape and arrangement on the surface.

Workability of Core Material

The workability of the core material was rated as follows according to the ease with which the core material could be worked during kneading. The results are shown in Table 1.

Good: Kneading operation was smoothly carried out.

Fair: Workability of the material during kneading was somewhat poor.

Poor: Workability of the material during kneading was very poor.

Flight Performance and Initial Velocity

The golf balls in each example were measured for initial velocity, carry, and total distance when hit with a driver (#1W) at head speeds of 50 m/s and 40 m/s using a swing robot.

Rebound

The core or enclosed core in each example was dropped under gravity onto a cylindrical iron plate having a diameter of 20 cm and a thickness of 20 cm from a height above the plate surface of 120 cm. The height to which the core rebounded was measured. The value shown for each core or enclosed core is an average of the measurements for ten cores (n=10) produced from the same formulation.

TABLE 1

| | | | EX 1 | EX 2 | EX 3 | EX 4 | CE 1 | CE 2 | CE 3 | CE 4 |
|---|---|---|---|---|---|---|---|---|---|---|
| Core | Composition (pbw) | Amilan UTL328*1 | 100 | 100 | | | | | | |
| | | Hytrel 5557*2 | | | 100 | 100 | | | | |
| | | Rilsan BMNO*3 | | | | | 100 | | | |
| | | BR-01*4 | | | | | | 100 | 100 | 100 |
| | | Zinc oxide | | | | | | 5 | 5 | 5 |
| | | Zinc diacrylate | | | | | | 28 | 30 | 25 |
| | | Antioxidant | | | | | | 0.2 | 0.2 | 0.2 |
| | | Dicumyl peroxide | | | | | | 1 | 1 | 1 |
| | | Tungsten | 10 | 25 | | | | | | |
| | | Barium sulfate | | | 20 | 20 | 45 | 32 | 10 | 20 |
| | Shape/ physical properties | Diameter (mm) | 5.0 | 10.0 | 14.0 | 14.0 | 18.0 | 35.0 | 15.0 | 35.0 |
| | | Weight (g) | 0.1 | 0.7 | 1.8 | 1.8 | 4.2 | 27.6 | 2.0 | 25.9 |
| | | Volume $V_3$ ($mm^3$) | 65.4 | 523.6 | 1436.8 | 1436.8 | 3053.6 | 22449.3 | 1767.1 | 22449.3 |
| | | Rebound A (cm) | 77 | 81 | 86 | 86 | 100 | 93 | 94 | 94 |
| | | Workability | good | good | good | good | poor | fair | good | good |
| Enclosing layer | Composition (pbw) | Hytrel 3078*2 | | 100 | | | | | | |
| | | Hytrel 3548W*2 | 100 | | | | | | | |
| | | Hytrel 4767*2 | | | 100 | | | | | |
| | | Himilan 1706*5 | | | | 50 | | 50 | | |
| | | Himilan 1605*5 | | | | 50 | | 50 | | |
| | | Rilsan BMNO*3 | | | | | | | 100 | |
| | | BR-01*4 | | | | | 100 | | | 100 |
| | | Zinc oxide | | | | | 5.0 | | | 5.0 |
| | | Zinc diacrylate | | | | | 25.0 | | | 20.0 |
| | | Antioxidant | | | | | 0.2 | | | 0.2 |
| | | Dicumyl peroxide | | | | | 1.0 | | | 1.0 |
| | | Tungsten | | 15 | | 15 | | | | |
| | | Barium sulfate | 10 | | | | 17.0 | | 25 | 25 |
| | Shape/ physical properties | Enclosed core diameter (mm) | 25.0 | 30.0 | 38.7 | 20.0 | 38.7 | 38.7 | 34.5 | 38.7 |
| | | Enclosed core weight (g) | 10.1 | 17.7 | 34.7 | 4.8 | 35.1 | 35.0 | 26.2 | 35.1 |
| | | Enclosing layer volume $V_2$ ($mm^3$) | 8181.2 | 13613.6 | 28911.3 | 2752.0 | 27294.5 | 7898.8 | 19733.7 | 7898.8 |
| | | Rebound B (cm) | 91 | 95 | 93 | 91 | 97 | 94 | 88 | 95 |
| Inter-mediate layer | Composition (pbw) | Himilan 1705*5 | 50 | | | | | | | |
| | | Himilan 1601*5 | 50 | | | | | | | |
| | | Himilan 1706*5 | | 50 | | | | | 50 | |
| | | Himilan 1605*5 | | 50 | | | | | 50 | |
| | | Hytrel 4767*2 | | | | 100 | | | | |
| | | Tungsten | 18 | | | | | | 17 | |
| | Shape | Diameter (mm) | 38.7 | 39.1 | | 38.7 | | | 38.7 | |
| | | Weight | 34.5 | 34.1 | | 35.0 | | | 35.1 | |
| Cover | Composition (pbw) | Himilan 1650*5 | 80 | | 80 | 80 | | 80 | 80 | 80 |
| | | Himilan 1706*5 | 20 | | 20 | 20 | 50 | 20 | 20 | 20 |
| | | Himilan 1605*5 | | | | | 50 | | | |
| | | Pandex EX7895*6 | | 100 | | | | | | |
| | | Barium sulfate | 8 | | | | | | | |
| | | Titanium oxide | 3.5 | 3 | 9 | 5 | 3 | 5 | 5 | 5 |
| Ball | Shape | Diameter (mm) | 42.7 | 42.7 | 42.7 | 42.7 | 42.7 | 42.7 | 42.7 | 42.7 |
| | | Weight (g) | 45.3 | 45.3 | 45.4 | 45.3 | 45.3 | 45.2 | 45.3 | 45.3 |
| | | $V_1/V_2$ (%) | 0.8 | 3.8 | 5.0 | 52.2 | 11.2 | 284.2 | 9.0 | 284.2 |

TABLE 1-continued

| | | EX 1 | EX 2 | EX 3 | EX 4 | CE 1 | CE 2 | CE 3 | CE 4 |
|---|---|---|---|---|---|---|---|---|---|
| HS = 50 m/s | Initial velocity (m/s) | 72.1 | 71.8 | 72.2 | 72.3 | 71.7 | 71.4 | 71.2 | 71.2 |
| | Carry (m) | 225.4 | 224.9 | 225.5 | 225.6 | 224.5 | 221.5 | 220.3 | 219.8 |
| | Total (m) | 235.1 | 234.2 | 235.3 | 235.3 | 233.9 | 230.1 | 229.5 | 229.4 |
| HS = 40 m/s | Initial velocity (m/s) | 58.7 | 58.5 | 58.8 | 58.6 | 58.5 | 58.6 | 58.7 | 58.5 |
| | Carry (m) | 184.0 | 183.7 | 184.0 | 184.2 | 182.5 | 183.6 | 183.9 | 183.0 |
| | Total (m) | 196.2 | 196.0 | 196.4 | 196.5 | 195.0 | 195.5 | 196.0 | 195.9 |

*1Nylon resin, produced by Toray Industries, Inc.
*2Thermoplastic polyester elastomer, produced by Dupont-Toray Co., Ltd.
*3Thermoplastic polyamide elastomer, produced by Dupont-Toray Co., Ltd.
*4cis-1,4-Polybutadiene, produced by Japan Synthetic Rubber Co., Ltd.
*5Ionomer resin, produced by Dupont-Mitsui Polychemicals Co., Ltd.
*6Thermoplastic polyurethane elastomer, produced by Dainippon Ink & Chemicals, Inc.

As is apparent from Table 1, the golf balls of Examples 1 to 4 according to the invention travel satisfactory distance both when the head speed is 50 m/s and 40 m/s. Noteworthy is an increase in distance relative to initial velocity when hit at a head speed of 40 m/s.

By contrast, the golf ball of Comparative Example 1 in which the rebound (B) of the enclosed core is smaller than the rebound (A) of the bare core, but the rebound (B) of the enclosed core itself is relatively large, satisfies to some extent the distance performance in the high head speed region, but is poor in distance performance at a head speed of 40 m/s. The golf ball of Comparative Example 3 in which the rebound (B) of the enclosed core is smaller than the rebound (A) of the bare core and the rebound (B) of the enclosed core itself is small, satisfies to some extent the distance performance in the low head speed region, but is poor in distance performance in the high head speed region. The golf balls of Comparative Examples 2 and 4 in which the percent $V_1/V_2$ is outside the scope of the invention are inferior in distance performance to the inventive golf balls. In Comparative Example 2, poor workability of the core material is also a problem.

Japanese Patent Application No. 11-195818 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A solid golf ball of multilayer structure comprising a core, an enclosing layer around the core, and a cover, wherein said core and said enclosing layer have volumes which satisfy the following relationship:

$$0.05\% \leqq (\text{core volume})/(\text{enclosing layer volume}) \times 100\% \leqq 60\%,$$

wherein said core is formed of a thermoplastic resin and of a composition comprising 100 parts by weight of a base and up to 40 parts by weight of an inorganic filler, and has a rebound of A (cm), and wherein said core enclosed with said enclosing layer has a rebound of B (cm), such that when both said core and said core enclosed with said enclosing layer are dropped under gravity from a height of 120 cm onto an iron plate of sufficient thickness A<B, and wherein the rebound A (cm) of said core is 50 to 90 cm.

2. The golf ball of claim 1 wherein said core has a diameter of 1 to 16 mm.

3. The golf ball of claim 1 wherein said enclosing layer is comprised of a thermoplastic resin as a base.

4. The golf ball of claim 1 wherein the rebound B of the core enclosed with the enclosing layer is at least 90 cm.

5. The golf ball of claim 1 wherein each of the enclosing layer and the cover is formed of a composition comprising 100 parts by weight of a base and up to 40 parts by weight on an inorganic filler.

6. The golf ball of claim 1, wherein the rebound B (cm) of said core enclosed with said enclosing layer is 90 to 110 cm.

7. The golf ball of claim 1, wherein said core has a diameter of 3 to 15.5 mm.

8. The golf ball of claim 1, wherein each of said enclosing layer and said cover is formed of a thermoplastic resin.

9. The golf ball of claim 1, wherein the composition forming core comprises an inorganic filler of 10 to 40 parts by weight.

10. The golf ball of claim 9, wherein the inorganic filler is selected from zinc oxide, barium sulfate, and tungsten.

11. A solid golf ball of multilayer structure comprising a core, an enclosing layer that encloses the core to define an enclosed core, an intermediate layer that encloses the enclosed core, and a cover that encloses the intermediate layer, wherein each of the core, the enclosing layer, the intermediate layer and the cover is comprised of a thermoplastic resin as a base, wherein the core further comprises 100 parts by weight of the base and up to 40 parts by weight of an inorganic filler, and wherein the rebound A (cm) of the core is 50 to 90 cm.

12. The golf ball of claim 11 wherein said core and said enclosing layer have volumes which satisfy the following relationship:

$$0.05\% \leqq (\text{core volume})/(\text{enclosing layer volume}) \times 100\% \leqq 60\%.$$

13. The golf ball of claim 11 wherein said core has a diameter of 1 to 16 mm.

14. The golf ball of claim 11 wherein the enclosed core and the intermediate layer have a rebound of at least 90 cm when dropped under gravity from a height of 120 cm onto an iron plate of sufficient thickness.

15. The golf ball of claim 11, wherein each of the enclosing layer and the cover is formed of a composition comprising 100 parts by weight of the base and up to 40 parts by weight of an inorganic filler.

16. The golf ball of claim 11, wherein the core is formed of a thermoplastic resin.

17. The golf ball of claim 11, wherein the core has a rebound of A (cm) and the enclosed core has a rebound of B (cm), and when both the core and the enclosed core are dropped under gravity from a height of 102 cm onto an iron plate of sufficient thickness A<B.

18. The golf ball of claim 11, wherein the core has a diameter of 3 to 15.5 cm.

19. The golf ball of claim 11, wherein the composition forming the core comprises an inorganic filler of 10 to 40 parts by weight.

20. The golf ball of claim 19, wherein the inorganic filler is selected from zinc oxide, barium sulfate, and tungsten.

21. The golf ball of claim 11, wherein the core has a rebound of A (cm) and the core enclosed with the enclosing layer has a rebound of B (cm), such that when both said core and said core enclosed with said enclosing layer are dropped under gravity from a height of 120 cm onto an iron plate of sufficient thickness A<B.

22. A solid golf ball of multilayer structure comprising a core, an enclosing layer around the core, and a cover, wherein said core and said enclosing layer have volumes which satisfy the following relationship:

$$0.05\% \leqq (\text{core volume})/(\text{enclosing layer volume}) \times 100\% \leqq 60\%,$$

wherein said core is formed of a thermoplastic resin and has a rebound of A (cm), and wherein said core enclosed with said enclosing layer has a rebound of B (cm), such that when both said core and said core enclosed with said enclosing layer are dropped under gravity from a height of 120 cm onto an iron plate of sufficient thickness A<B, and wherein the rebound B of the core enclosed with the enclosing layer is at least 90 cm.

23. A solid golf ball of multilayer structure comprising a core, an enclosing layer around the core, and a cover, wherein said core and said enclosing layer have volumes which satisfy the following relationship:

$$0.05\% \leqq (\text{core volume})/(\text{enclosing layer volune}) \times 100\% \leqq 60\%,$$

wherein said core is formed of a thermoplastic resin and has a rebound of A (cm), and wherein said core enclosed with said enclosing layer has a rebound of B (cm), such that when both said core and said core enclosed with said enclosing layer are dropped under gravity from a height of 120 cm onto an iron plate of sufficient thickness A<B, and wherein the rebound B (cm) of said core enclosed with said enclosing layer is 90 to 110 cm.

* * * * *